US010401119B1

(12) United States Patent
Mathews

(10) Patent No.: US 10,401,119 B1
(45) Date of Patent: Sep. 3, 2019

(54) PAINT PELLET PISTOL

(71) Applicant: Frances Mathews, Whiteville, TN (US)

(72) Inventor: Frances Mathews, Whiteville, TN (US)

( * ) Notice: Subject to any disclaimer, the term of this patent is extended or adjusted under 35 U.S.C. 154(b) by 0 days.

(21) Appl. No.: 16/041,218

(22) Filed: Jul. 20, 2018

Related U.S. Application Data

(60) Provisional application No. 62/534,716, filed on Jul. 20, 2017.

(51) Int. Cl.
*F41B 11/62* (2013.01)
*F41B 11/70* (2013.01)
*F41B 11/51* (2013.01)

(52) U.S. Cl.
CPC ..... *F41B 11/62* (2013.01); *F41B 11/51* (2013.01); *F41B 11/70* (2013.01)

(58) Field of Classification Search
CPC ..... F41B 11/62; F41C 9/00; F41C 9/02
USPC ..... 124/64, 69; 42/1.09
See application file for complete search history.

(56) References Cited

U.S. PATENT DOCUMENTS 3,267,600 A * 8/1966 Ryan ..... F41C 3/06 124/2
4,241,850 A * 12/1980 Speer ..... F41H 9/10 116/214
4,583,958 A * 4/1986 Matsuda ..... A63H 5/04 124/27
4,625,621 A * 12/1986 Warin ..... F41C 9/02 42/1.09
5,103,366 A 4/1992 Battochi
5,529,300 A * 6/1996 Frazier ..... F41B 15/02 124/56
5,791,327 A * 8/1998 Riggs ..... F41A 19/18 124/56
5,893,483 A * 4/1999 Duran ..... F41H 9/10 206/38.1
5,988,450 A * 11/1999 Cassarino ..... F41H 9/10 222/192
6,546,874 B2 * 4/2003 Vasel ..... F41B 15/02 102/367
6,778,811 B1 * 8/2004 Grove ..... F41A 17/04 224/539
7,483,715 B2 1/2009 Kroll et al.
7,946,284 B2 * 5/2011 DeLaquil ..... F41B 6/00 124/72
2003/0003950 A1 * 1/2003 Kroll ..... H04B 1/3833 455/557
2003/0050088 A1 * 3/2003 Kroll ..... H04B 1/3833 455/550.1
2004/0217141 A1 11/2004 Brooks
(Continued)

FOREIGN PATENT DOCUMENTS

GB 2193797 A * 2/1988 ..... F41A 19/10

*Primary Examiner* — Jonathan C Weber
(74) *Attorney, Agent, or Firm* — Cramer Patent & Design, PLLC; Aaron R. Cramer

(57) ABSTRACT

A small pistol device that shoots red paint pellets is intended to be used for personal protection. The pistol is disguised to appear as a rectangular cellular phone. The pistol is intended to be worn discreetly upon a user's belt using a clip. During a confrontation, a user would fire a paint pellet at the perpetrator causing the release of paint. It is intended that the perpetrator would think they have been shot, thereby providing an opportunity for the user to escape.

6 Claims, 3 Drawing Sheets

(56) References Cited

U.S. PATENT DOCUMENTS

| | | | | |
|---|---|---|---|---|
| 2006/0027223 | A1* | 2/2006 | Vasel | F41B 11/62 124/57 |
| 2006/0191525 | A1 | 8/2006 | Dai | |
| 2007/0151551 | A1 | 7/2007 | Verini | |
| 2007/0235358 | A1 | 10/2007 | Lee | |
| 2008/0168693 | A1* | 7/2008 | Palau | F41C 9/02 42/1.09 |
| 2009/0064979 | A1* | 3/2009 | Andrews | F41B 11/89 124/65 |
| 2009/0124231 | A1* | 5/2009 | Kroll | H04M 1/677 455/404.1 |
| 2009/0183413 | A1* | 7/2009 | Smith | F41B 9/0031 42/1.08 |
| 2013/0244724 | A1 | 9/2013 | Monti et al. | |
| 2014/0027479 | A1 | 1/2014 | Hogue | |
| 2017/0146314 | A1* | 5/2017 | Nelson | F41C 9/02 |
| 2017/0205186 | A1* | 7/2017 | Kjellberg | F41C 9/02 |

* cited by examiner

PAINT PELLET PISTOL

RELATED APPLICATIONS

The present invention was first described in and claims the benefit of U.S. Provisional Patent Application No. 62/534,716 filed on Jul. 20, 2017, the entire disclosures of which are incorporated herein by reference.

FIELD OF THE INVENTION

The present invention relates generally to a small firearm that delivers paint pellets.

BACKGROUND OF THE INVENTION

As any person will attest, security is an area of primary concern, especially in recent times. Due to the fact that people tend to place a high value on their property and personal safety, the marketplace has responded with a variety of products that are intended to protect oneself from harm while protecting their dwelling and belongs as well. Perhaps the most common device that is thought of is that of a conventional firearm such as a pistol. However, firearms require a great deal of training, practice, foresight, and a commitment to take another person's life that many do not have in a time of stress. Additionally, such devices are heavy to constantly carry and cause devastating injuries in the event of an accidental discharge.

Pepper spray or mace products are also viable options but are proving ineffective with many perpetrators who are very large or under the influence of drugs. Accordingly, there exists a need for a means by which one can protect themselves and their belongings in a manner that addresses the above problems. The use of the invention provides for enhanced personal safety in a manner which is not only quick, easy and effective, but addresses many of the shortcomings of current protection methods.

SUMMARY OF THE INVENTION

To achieve the above and other objectives, the present invention provides for a paint pellet pistol, comprising a housing having a front surface, an applied artwork disguising the paint pellet pistol and a trigger release integral to an internal trigger mechanism along a bottom side surface of the housing. The trigger release and the internal trigger mechanism act to discharge a paint pellet from a barrel aperture which is located along a front side surface of the housing. The trigger mechanism includes a safety button which protrudes from the bottom side surface of the housing. The safety button mechanically prevents accidental discharge of the paint pellet when the paint pellet pistol is pressed inward before pressing the trigger release to discharge the paint pellet.

The pistol may also comprise an internal gas cartridge compartment which is accessed along a rear side surface of the housing to insertingly contain a standard miniature carbon dioxide cartridge, which in turn provides a propellant which is to act upon and propel the paint pellet during discharge. There may also be an internal gas cartridge compartment which may be accessed along the rear side surface of the housing to insertingly contain a compressed air gas cartridge, which in turn provides a propellant which is to act upon and propel the paint pellet during discharge.

The paint pellet compartment may be of a cylindrical shape storing one or more paint pellets and is closed via a threaded paint pellet compartment lid. A gas cartridge compartment may be closed via a threaded gas compartment lid which holds and positions the gas cartridge. There may also be an internal paint pellet compartment located along a rear side surface of the housing.

The applied artwork may resemble a cellular phone and is intended to be worn discreetly upon a belt. The paint pellet pistol may be used to fire the paint pellet at a perpetrator, causing a release of paint intended to cause the perpetrator to think they have been shot and provide time for escape.

In a separate embodiment, the paint pellet pistol may also comprise a belt clip capable of positioning the paint pellet pistol at an arm's reach along a rear surface of the housing allowing the paint pellet pistol attached to a belt thereby positioning the paint pellet pistol in a ready position to be easily grasped and removed from the belt when needed. As a consequence, during a dangerous confrontation, a user would quickly grasp the paint pellet pistol, press the safety button, aim the barrel aperture, and fire a paint pellet at a perpetrator. The belt may also have an internal paint pellet compartment located along a rear side surface of the housing. In either embodiment, a given paint pellet may be red in color.

The paint pellet pistol may be used in the following manner: first, procuring said paint pellet pistol; second, removing a gas compartment lid; third, inserting a gas cartridge; fourth, closing said gas compartment lid; fifth, removing said paint pellet compartment lid; sixth, loading at least one paint pellet into said paint pellet compartment; seventh, closing said paint pellet compartment lid; eighth, clipping said paint pellet pistol to a user's belt using said belt clip; ninth, participating in a walking activity or a running activity; tenth, experiencing a threatening confrontation; eleventh, grasping said paint pellet pistol; twelfth, removing said paint pellet pistol from said user's belt; thirteenth, pressing said safety button; fourteenth, aiming said barrel aperture portion of said paint pellet pistol at said perpetrator; fifteenth, pressing upon said trigger release to discharge a paint pellet at said perpetrator; sixteenth, fleeing said scene of said encounter; and last, benefiting from a discreet and effective means to repel said perpetrator with said paint pellet pistol.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
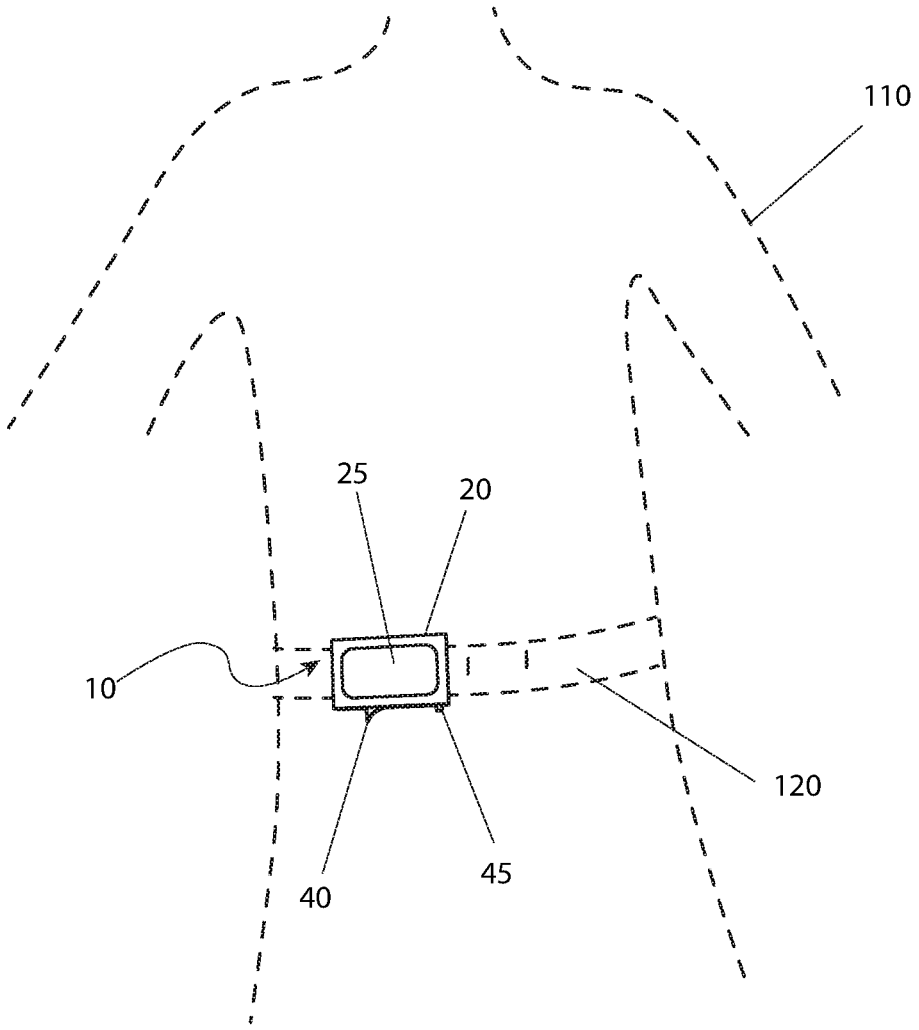
FIG. 1 is an environmental view of a paint pellet pistol 10 depicting an in-use state, according to a preferred embodiment of the present invention.

10 paint pellet pistol
20 housing
25 artwork
30 belt clip
40 trigger

42 trigger mechanism
45 safety button
48 barrel aperture
50 gas compartment
55 gas compartment lid
57 gas cartridge
60 paint pellet compartment
65 paint pellet compartment lid
100 paint pellet
110 user
120 belt

DETAILED DESCRIPTION OF THE PREFERRED EMBODIMENT

1. Description of the Figures

Figure 2:
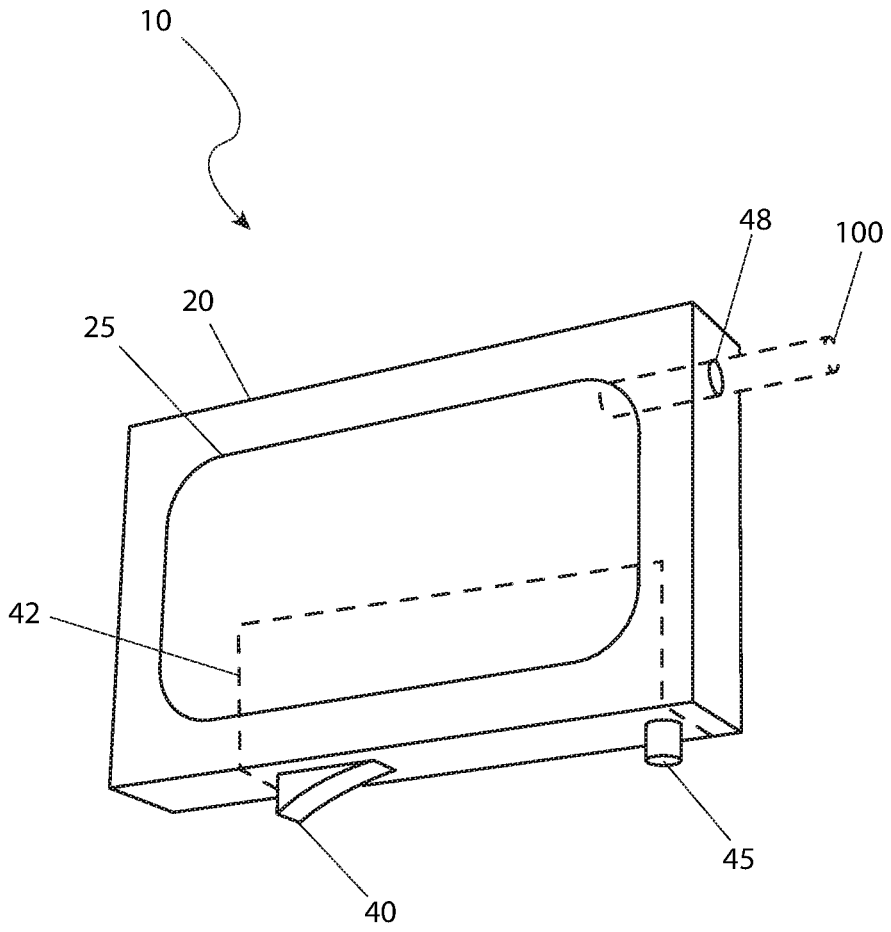
FIG. 2 is a front perspective view of the paint pellet pistol 10, according to a preferred embodiment of the present invention; and, FIG. 3 is a rear perspective view of the paint pellet pistol 10, according to a preferred embodiment of the present invention.
Figure 3:
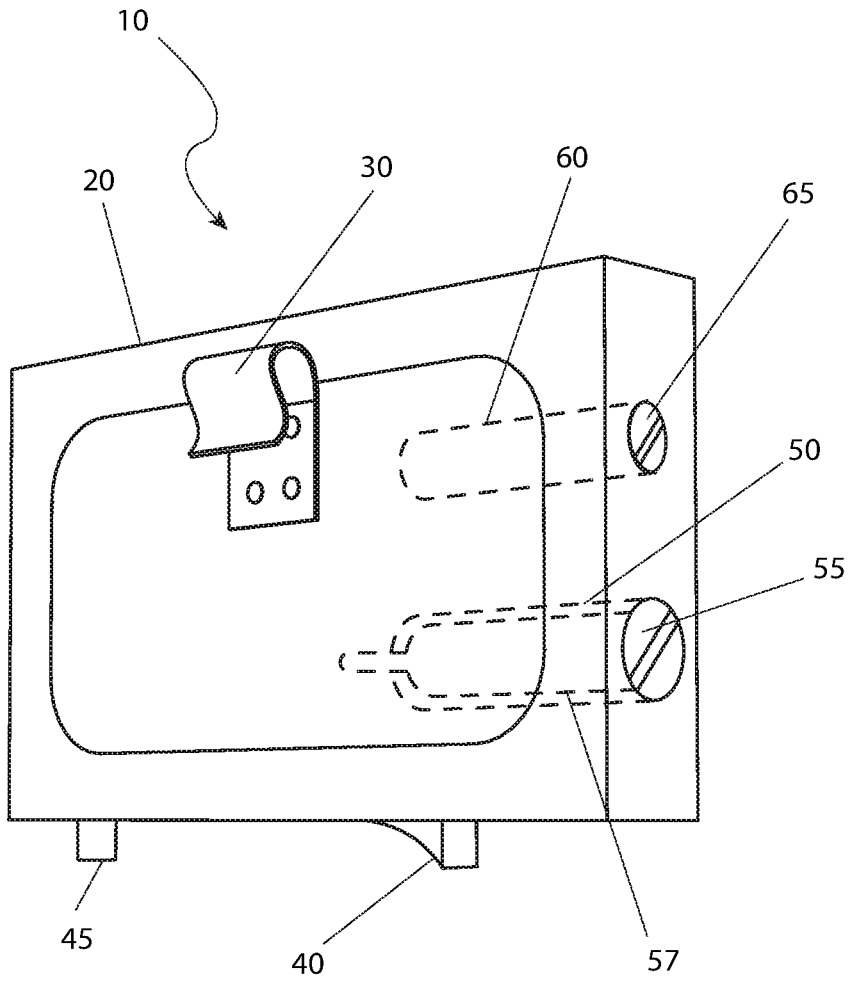

The best mode for carrying out the invention is presented in terms of its preferred embodiment, herein depicted within FIGS. 1 through 3. However, the invention is not limited to the described embodiment, and a person skilled in the art will appreciate that many other embodiments of the invention are possible without deviating from the basic concept of the invention and that any such work around will also fall under scope of this invention. It is envisioned that other styles and configurations of the present invention can be easily incorporated into the teachings of the present invention, and only one (1) particular configuration shall be shown and described for purposes of clarity and disclosure and not by way of limitation of scope.

The terms "a" and "an" herein do not denote a limitation of quantity, but rather denote the presence of at least one (1) of the referenced items.

The present invention describes a paint pellet pistol (herein described as the "device") 10, which provides a small lightweight pistol-like device that shoots paint pellets 100. The device 10 is intended to be used for personal protection and takes the form of a rectangular cellular phone. The device 10 is intended to be worn discreetly upon a user's belt 120. During a confrontation, a user 110 would fire a paint pellet 100, preferably of a red color, at the perpetrator, causing the release of paint. The use of the device 10 is intended to cause the perpetrator to think they have been shot and provide time for the user 100 to escape.

Referring now to FIG. 1, an environmental view of the device 10 depicting an in-use state, according to a preferred embodiment of the present invention, is disclosed. The device 10 provides a rectangular housing 20 having dimensions of approximately five inches (5 in.) in length, two-and-one-half inches (2½ in.) in width, and three-quarters of an inch (¾ in.) in depth, thereby resembling a cellular phone. The device 10 includes a side-mounted belt clip 30 which positions the device 10 at an arm's reach to the user 110. During a dangerous confrontation, the user would quickly grab the device 10 and fire a paint pellet 100 at a perpetrator. The discharge of the paint pellet 100 from the device 10 upon the perpetrator will result in the deposit of the red paint upon the perpetrator, causing the perpetrator to think they have been shot with a firearm. Additionally, the red paint stain will make it easy to identify the perpetrator. It is envisioned that the device 10 would be easy to carry and would be especially beneficial when used by likely victims such as women and young girls.

Referring now to FIGS. 2 and 3, front and rear perspective views of the device 10, according to a preferred embodiment of the present invention, are disclosed. A front surface of the rectangular housing 20 is envisioned to provide printed or otherwise applied artwork 25 which resembles an appearance of a cellular phone so as to disguise the device 10.

An embodiment of the device 10 is illustrated here which provides an internal paint pellet compartment 60 located along a rear side surface of the housing 20. The paint pellet compartment 60 is envisioned to be of a cylindrical shape being capable of storing one (1) or more paint pellets 100. The paint pellet compartment 60 is envisioned to be closed via a threaded paint pellet compartment lid 65.

A trigger release 40 together with an internal trigger mechanism 42 are located along a bottom side surface of the housing 20. The trigger release 40 and trigger mechanism 42 act to discharge the paint pellet 100 from a barrel aperture 48 located along a front side surface of the housing 20. The trigger mechanism 42 also includes a safety button 45 which protrudes from the bottom side surface of the housing 20. The safety button 45 mechanically prevents accidental discharge of a paint pellet 100 from the device 10 and would be pressed inward by the user 110 before pressing the trigger release 40 to discharge a paint pellet 100.

The embodiment of the device 10 shown here also includes an internal gas cartridge compartment 50, being accessed along a rear side surface of the housing 20. The gas cartridge compartment 50 is to have a suitable shape and size to insertingly contain a standard miniature CO2 or compressed air gas cartridge 57 which in turn provides a propellant which is to act upon and propel the paint pellet 100 during discharge. The gas cartridge compartment 50 is envisioned to be closed via a threaded gas compartment lid 55 which holds and positions the gas cartridge 57 within. It is understood that the device 10 may also utilize a spring-operated mechanism or other equivalent means, in lieu of the gas cartridge 57, to propel the paint pellet 100, and as such should not be interpreted as a limiting factor of the device 10.

A belt clip 30 along a rear surface of the housing 20 allows the device 10 to be attached to a user's belt 120, thereby positioning the device 10 in a ready position to be easily grasped and removed from the user's belt 120 when needed. During a dangerous confrontation, the user 110 would quickly grasp the device 10, press the safety button 45, aim the barrel aperture 48, and fire a paint pellet 100 at the perpetrator.

It is envisioned that other styles and configurations of the present invention can be easily incorporated into the teachings of the present invention, and only one (1) particular configuration shall be shown and described for purposes of clarity and disclosure and not by way of limitation of scope.

2. Operation of the Preferred Embodiment

The preferred embodiment of the present invention can be utilized by the common user in a simple and effortless manner with little or no training. After initial purchase or acquisition of the device 10, it would be installed as indicated in FIG. 1.

The method of preparing and utilizing the device 10 may be achieved by performing the following steps: procuring the device 10; removing the gas compartment lid 55; inserting a gas cartridge 57; closing the gas compartment lid 55; removing the paint pellet compartment lid 65; loading at least one (1), paint pellet 100, preferably of a red color, into the paint pellet compartment 60; closing the paint pellet compartment lid 65; clipping the device 10 a user's belt 120 using the belt clip 30; participating in an activity such as walking, running, or the like; experiencing a threatening confrontation; grasping the device 10; removing the device 10 from the user's belt 120; pressing the safety button 45; aiming the barrel aperture portion 48 of the device 10 at the perpetrator; pressing upon the trigger 40 to discharge a paint pellet 100 at the perpetrator; fleeing the scene of the encounter; and, benefiting from a discreet and effective means to repel a perpetrator, afforded a user of the present invention 10.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

The invention claimed is:

1. A paint pellet pistol, comprising:

a housing having a front surface;

an applied artwork disguising said paint pellet pistol;

a trigger release integral to an internal trigger mechanism along a bottom side surface of said housing, said trigger release and said internal trigger mechanism act to discharge a paint pellet from a barrel aperture located along a front side surface of said housing, said trigger mechanism includes a safety button which protrudes from said bottom side surface of said housing, said safety button mechanically prevents accidental discharge of said paint pellet before pressing said trigger release to discharge said paint pellet;

a gas cartridge compartment accessed along a rear side surface of said housing to insertingly contain a miniature carbon dioxide cartridge, which in tum provides a propellant which is to act upon and propel said paint pellet during discharge; and a paint pellet compartment located along a rear side surface of said housing;

wherein said applied artwork resembles a cellular phone and the housing is configured to be worn upon a belt;

wherein said paint pellet compartment is a cylindrical shape storing one or more paint pellets and is closed via a threaded paint pellet compartment lid.

2. The paint pellet pistol according to claim 1, wherein said gas cartridge compartment is closed via a threaded gas compartment lid which holds and positions said gas cartridge.

3. A paint pellet pistol, comprising:

a housing having a front surface;

an applied artwork disguising said paint pellet pistol;

a trigger release integral to an internal trigger mechanism along a bottom side surface of said housing, said trigger release and trigger mechanism act to discharge a paint pellet from a barrel aperture located along a front side surface of said housing, said trigger mechanism includes a safety button which protrudes from said bottom side surface of said housing, said safety button mechanically prevents accidental discharge of said paint pellet before pressing said trigger release to discharge said paint pellet;

a belt clip configured to allow said housing to be attached to a belt an internal paint pellet compartment located along a rear side surface of said housing; and an internal gas cartridge compartment accessed along a rear side surface of said housing to insertingly contain a miniature carbon dioxide cartridge, which in turn provides a propellant which is to act upon and propel said paint pellet during discharge;

wherein said paint pellet compartment is a cylindrical shape storing one or more paint pellets and is closed via a threaded paint pellet compartment lid.

4. The paint pellet pistol according to claim 3, wherein said gas cartridge compartment is closed via a threaded gas compartment lid which holds and positions said gas cartridge.

5. The paint pellet pistol according to claim 3, wherein said housing is rectangular.

6. The paint pellet pistol according to claim 3, wherein said housing is five inches in length, two-and-one-half inches in width, and three-quarters of an inch in depth.

* * * * *